US005833244A

United States Patent [19]

Salt et al.

[11] Patent Number: 5,833,244

[45] Date of Patent: Nov. 10, 1998

[54] GAS TURBINE ENGINE SEALING ARRANGEMENT

[75] Inventors: Allan J Salt, Warwickshire; Alan Cash, Derby; Carlton Smith, West Yorkshire, all of England

[73] Assignee: Rolls-Royce p l c, London, England

[21] Appl. No.: 745,610

[22] Filed: Nov. 8, 1996

[30] Foreign Application Priority Data

Nov. 14, 1995 [GB] United Kingdom ..... 9523226

[51] Int. Cl.[6] ..... F16J 15/447

[52] U.S. Cl. ..... 277/421; 277/418; 415/170.1; 415/115; 416/95; 416/198 A

[58] Field of Search ..... 277/418, 421; 415/115, 134, 170.1, 173.1; 416/95, 198 A

[56] References Cited

U.S. PATENT DOCUMENTS

| | | | |
|---|---|---|---|
| 4,035,102 | 7/1977 | Maghon | 416/198 A |
| 4,127,359 | 11/1978 | Stephan | 416/198 A |
| 4,265,594 | 5/1981 | Eggmann | 416/198 A |
| 4,277,225 | 7/1981 | Dubois et al. | 416/198 A |
| 4,468,148 | 8/1984 | Seymour | 416/198 A |
| 4,483,054 | 11/1984 | Ledwith | 416/198 A |
| 4,820,116 | 4/1989 | Hovan et al. | 415/115 |
| 4,884,950 | 12/1989 | Brodell et al. | 416/198 A |
| 5,462,403 | 10/1995 | Pannone | 415/173.1 |
| 5,488,825 | 2/1996 | Davis et al. | 415/115 |

FOREIGN PATENT DOCUMENTS

| | | | |
|---|---|---|---|
| 612097 | 11/1948 | United Kingdom . | |
| 0822172 | 10/1959 | United Kingdom | 415/198 A |
| 1012066 | 12/1965 | United Kingdom . | |
| 1236920 | 6/1971 | United Kingdom . | |
| 1502549 | 3/1978 | United Kingdom . | |
| 2 226 366 | 6/1990 | United Kingdom . | |
| 2272946 | 6/1994 | United Kingdom | 415/170.1 |
| 2 280 478 | 1/1995 | United Kingdom . | |

*Primary Examiner*—Eric K. Nicholson
*Assistant Examiner*—John L. Beres
*Attorney, Agent, or Firm*—W. Warren Taltavull

[57] ABSTRACT

In a sealing arrangement between two discs of a gas turbine engine a split sealing arrangement comprising a pair of sealing formations each made up of a plurality of sealing segments is provided. Each of the segments has a root accommodated in serrations of the discs. The roots of the sealing segments are positively connected to roots of the rotor blades by dovetail or T-shaped tongues and grooves. The sealing segments are also provided with internal cooling passages.

23 Claims, 8 Drawing Sheets

GAS TURBINE ENGINE SEALING ARRANGEMENT

FIELD OF THE INVENTION

The present invention relates to a gas turbine engine, and particularly to means for sealing the gas flow path in a gas turbine engine. In particular the invention relates to sealing the gas flow path in an industrial gas turbine engine.

BACKGROUND OF THE INVENTION

Industrial gas turbine engines generally comprise a gas generator consisting of a compressor, a combustion apparatus in which fuel and air are mixed and burnt, a turbine which is driven by the products of combustion and which drives the compressor, and a power turbine driven by the high temperature high velocity gases from the gas generator. The power turbine is arranged to drive loads such as an electricity generator, or pump for pumping oil or gas.

Heavyweight industrial gas generators are bulky and there are large distances between the bearings of a shaft on which the compressor and turbine are mounted. The turbine and a gas generator will comprise one or more stages of blades, each stage comprising an array of rotor blades mounted on the gas generator shaft and an array of stator vanes mounted from the casing of the gas generator. The high temperature, high velocity gases flow through an annular passage in which the rotating rotor blades and stationary stator vanes are disposed and the radially inner boundary of the annular passage is partially defined by platforms on the inner ends of the stator vanes. These platforms are usually sealingly engaged by sealing elements secured to rotors on which the rotor blades are located.

The relatively large distances between the shaft bearings, for example up to nine metres, results in excessive rotor blade movement relative to the gas generator casing due to differential thermal expansion between the shaft and the casing. Thus the types of seals between the rotating and static components of the gas generator turbine which are typical of lightweight turbines derived from aero gas turbine engines are not practical.

Also in the case of a known type of heavyweight gas generator turbine, the turbine rotors combine drums which are welded together. Such a form of construction limits the options available for providing rotating sealing elements to cooperate with the platforms on the stator. This limitation arises because a welded construction does not allow insertion of extra components between the rotors to carry the sealing elements.

In the case of relatively low power engines a seal can be achieved by casting projections or "wings", otherwise known as heat shields, onto the platforms at the inner ends of the rotor blades. These projections on the rotor blades on adjacent stages abut one another to form a seal. On larger engines these wings become so long that the bending stresses on the wings are excessive. Also when the rotor blades are cast by the directional solidification technique, the material properties for the wings are not appropriate to their loading.

SUMMARY OF THE INVENTION

The present invention seeks to provide an improved form of sealing arrangement between adjacent discs of the turbine rotor.

Accordingly the present invention provides a sealing arrangement between two adjacent discs of a gas turbine rotor, the rotor discs having serrations in their periphery, the arrangement including, on each said disc, a circumferentially extending sealing formation extending from the disc axially towards the other disc and bridging part of the space between the two discs, free ends of the two sealing formations cooperating to form a seal and each sealing formation comprising a plurality of segments, the segments locating in the rotor disc serrations.

The sealing formations are, advantageously, each about half the blade platform to blade platform spacing in axial extent.

The sealing formations are usually short cylinders or short frusto-conical spigots. For convenience the term cylinder is used hereafter.

The free ends of the two cylinders may be inter-engaged in the manner of a tongue and groove connection to form a seal. Desirably, however, each free edge of each cylinder is formed with a slot and a sealing strip is inserted within the spaces defined between the slots. Alternatively, the edges of the cylinders may be provided with respective tongues and the two facing tongues may be engaged within an H-section sealing strip.

In a similar manner the generally axially extending edges of the individual segments may be united and sealed relative to adjacent segments in comparable ways.

Each sealing segment may have a body having a radially inner or root portion provided with serrations complementary to the serrations provided in the periphery of the disc, and a column extending radially from such root portion supports a relatively thin sealing panel, or heatshield panel, which provides the usual outwardly extending fins for sealing engagement with platforms on the inner ends of the stator vanes.

In order to prevent bending of the sealing panel due to centrifugal force it is possible for the panel to have a generally axially extending spine united with its column.

Desirably, however, such a spine or a thicker structure is dispensed with in order to reduce centrifugal force by having a relatively light planar sealing segment, and centrifugal force is borne by an integrally formed tie which extends from the body of the segment, usually from the root, to a position adjacent the free edge of the segment.

Desirably each sealing segment is mounted by a root which engages the same disc serration, or serrations, as a root of a rotor blade and each segment is connected to its respective rotor blade to restrain it against axial movement out of the serration, or serrations.

Desirably the connection between the sealing segment root and the blade root is a positive connection.

The connection may be by means of a dovetail slot, a T-slot or the like.

Preferably the spines of the sealing segments are hollow to define axially extending interconnecting passages for the flow of cooling fluid. The bodies of the sealing segments on at least one of the upstream rotor disc or downstream rotor disc may be hollow to define radially extending passages for the flow of cooling fluid. The passages in the bodies of the sealing segments on the upstream rotor disc may be closed at their radially outer ends, the bodies have apertures to discharge the cooling fluid into the space between the adjacent rotor discs, and the downstream ends of the spines of the sealing segments on the downstream rotor disc have apertures to allow cooling fluid to flow from the space between the adjacent rotor discs into the axially extending passages in the spines of the sealing segments. At least one sealing plate may be located between at least one of the sealing formations and the corresponding rotor disc. There may be a plurality of sealing plates, each sealing plate locates in a recess a respective one of the sealing formations.

BRIEF DESCRIPTION OF THE DRAWING

The invention will be described further, by way of example, with reference to the accompanying drawings, wherein:

FIG. 13 is a sectional view showing the H-section sealing strip; and

FIG. 14 is a sectional view of a mortice and tennon connection.

DETAILED DESCRIPTION OF THE INVENTION

Figure 1:
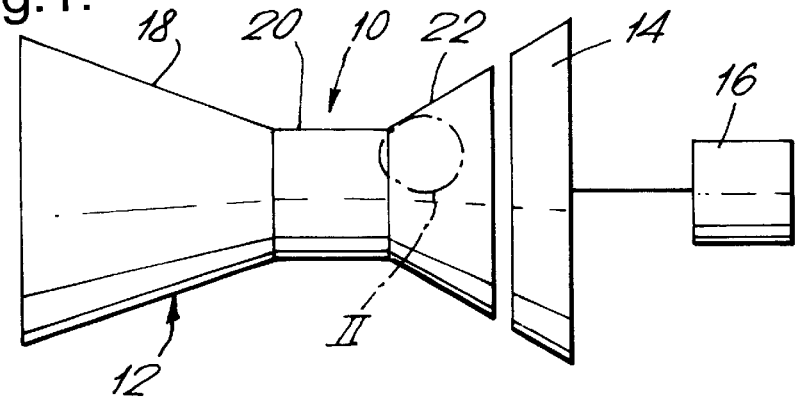
FIG. 1 shows diagrammatically an industrial gas turbine engine.

Referring to the drawings, in FIG. 1 there is shown an industrial gas turbine power plant 10 comprising a gas generator 12 and a power turbine 14 arranged to drive a load 16 which may be for example an electricity generator or a pump. The gas generator 12 comprises, in axial flow series, a compressor 18, a combustor 20 and a turbine 22 mounted on a common shaft with the compressor 18. High temperature, high velocity gas produced in the gas generator 12 by combustion of fuel and compressed air in the combustor 20, drives turbine 22, which drives the compressor 18 through the common shaft. The excess power in the turbine gases after passage through the turbine 22 is used to drive the power turbine 14.

Figure 2:
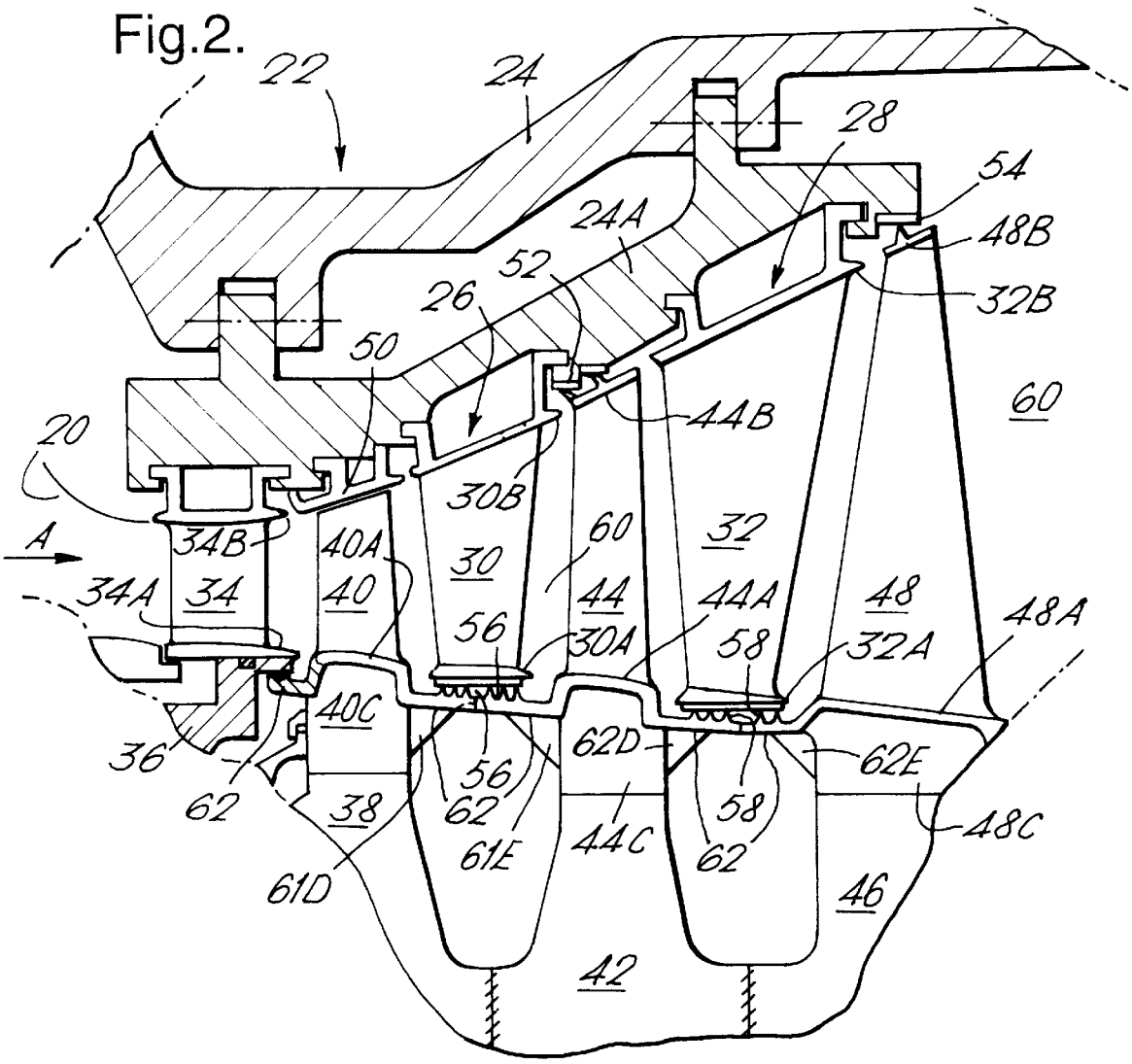
FIG. 2 shows part of a known gas generator incorporating a known type of gas flow path sealing construction.

Referring to FIG. 2 there is shown a detailed view of a known turbine 22 of a gas generator 12. The turbine 22 comprises an outer casing 24 to which are attached via an intermediate casing 24A stator vane stages 26 and 28 comprising stator vanes 30 and 32. An array of nozzle guide vanes 34 is secured between the intermediate casing 24A and a radially inner static support structure 36. The stator vanes 30 and 32 and the nozzle guide vanes 34 all have inner and outer platforms 30A, 30B, 32A, 32B, 34A, 34B respectively.

The turbine 22 includes a first stage rotor disc 38 having rotor blades 40 located between the nozzle guide vanes 34 and the stator vanes 30, a second stage rotor disc 42 having rotor blades 44 located between the stator vanes 30 and the stator vanes 32, and a third stage rotor disc 46 having rotor blades 48 located downstream of the stator vanes 32. The rotor blades 40, 44, 48 all have inner platforms 40A, 44A and 48A respectively. The outer tips of the first stage rotor blades 40 cooperate with a static sealing ring 50 held in intermediate casing 24A, but the outer tips of the rotor blades 44 and 48 have shrouds 44B and 48B with projections which sealingly cooperate with abradable surfaces 52 and 54 on the intermediate casing 24A.

The inner and outer platforms 30A, 30B, 32A, 32B, 34A and 34B of the stator vanes 30, 32 and the nozzle guide vanes 34 and the inner platforms 40A, 44A and 48A of the rotor blades 40, 44 and 48 define an annular gas flow passage 60 through which the products of combustion flow from the combustor 20.

The radially inner boundary of the annular gas flow passage 60 is sealed by means of fins 56 and 58 formed on sealing wings 62 which are cast with the rotor blades 40, 44 and 48.

It will be appreciated that while the engine 10 and thus the turbine 22 is relatively small the wings 62 will be sufficiently strong and durable to provide adequate sealing at the inner boundary of the annular gas flow passage 60. As the engine 20 size increases the spaces between the turbine rotors 38 and 42 and between the turbine rotors 42 and 46 will increase and the diameters of the rotors 38, 42 and 46 will also increase. Thus the wings 62 will tend to increase in axial length and be located at larger diameters. Eventually having regard to the working load imposed upon the wings 62 the materials and manufacturing methods available will place a limit on the length of the wing 62 and the diameter of the wing 62 location which will maintain adequate sealing.

Figure 3:
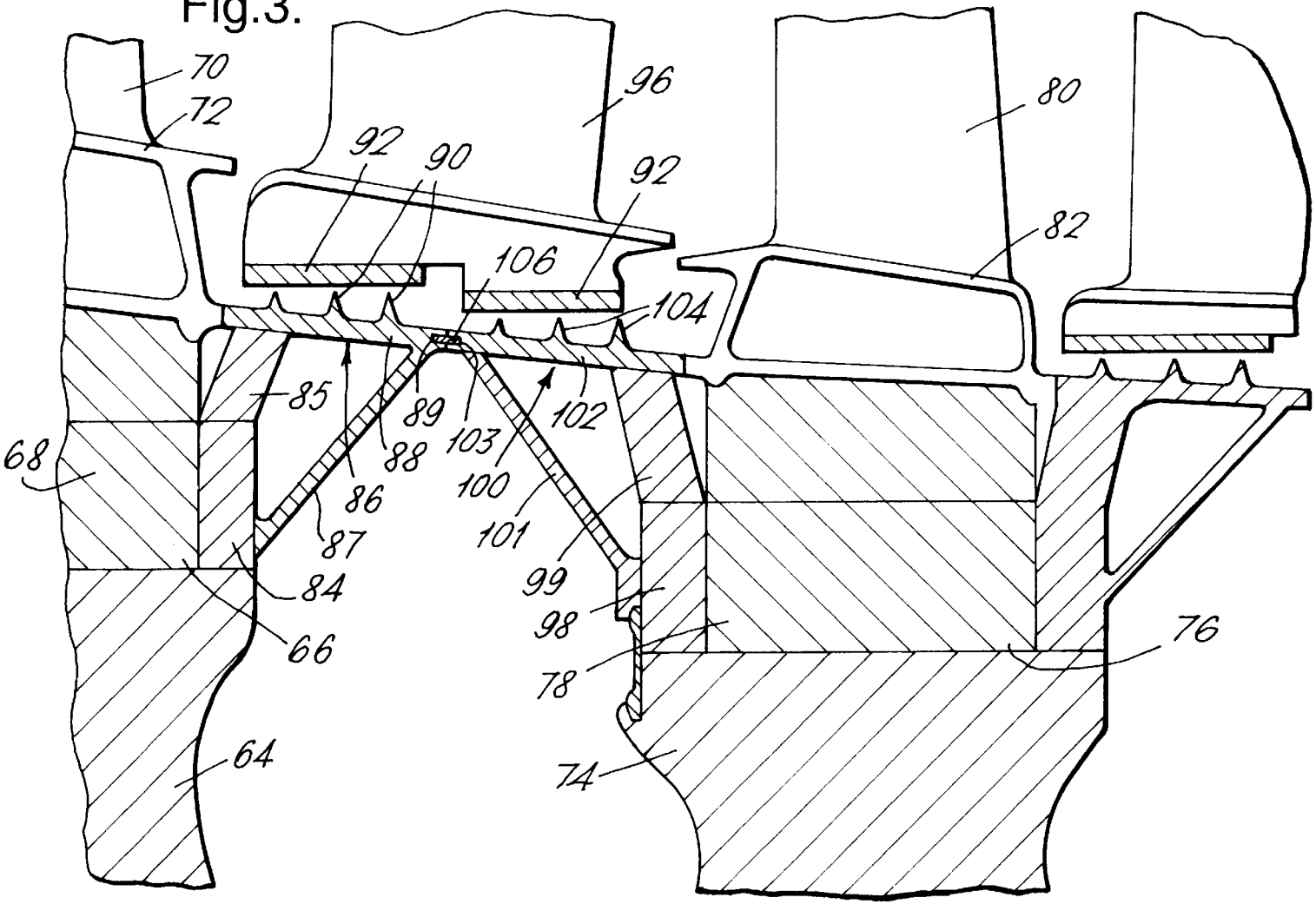
FIG. 3 shows part of a gas generator incorporating a gas flow path sealing construction according to the present invention.

Referring to FIGS. 3 to 8 in which a part of a gas turbine engine provided with a sealing arrangement according to the present invention. In FIG. 3 the first stage rotor disc 64 has serrations 66, each of which receives the root 68 of one of a plurality of rotor blades 70. Each rotor blade 70 also has a platform 72. Similarly the second stage rotor disc 74 has serrations 76, each of which receives the root 78 of one of a plurality of rotor blades 80. The rotor blades 80 also have platforms 82.

Each of the serrations 66 also receives a root 84 of one of a plurality of circumferentially arranged sealing segments 86. Each sealing segment 86 has a main operative panel 88 carrying sealing ribs 90 which cooperate, in conventional manner, with surfaces 92 of stator vanes 96. Similarly each of the serrations 76 also receives a root 98 of one of a plurality of circumferentially arranged sealing segments 100. Each of the sealing segments 100 has a main operative panel 102 carrying sealing ribs 104 which also cooperate with the surfaces 92 on the stator vanes 96.

The panels 88 and 102 are relatively thin to render the segments of relatively low weight and therefore centrifugal forces are reduced. The panels 88 and 102 are usually a segment of a cone or a segment of a cylinder.

All of the sealing segments 86 unite to form a frusto-conical sealing formation or a cylindrical sealing formation which extends axially downstream from the first stage rotor disc 64 towards the second stage rotor disc 74. All of the sealing segments 100 unite to form a frusto-conical sealing formation or a cylindrical sealing formation which extends axially upstream from the second stage rotor disc 74 towards the first stage rotor disc 64. The free edges of the two formations are sealingly engaged and provide an effective heat shield and sealing arrangement on the internal periphery of the annular gas flow passage.

The ribs 90 on the circumferentially adjacent sealing segments 86 unite to form circumferentially extending sealing fins and similarly the ribs 104 on the circumferentially adjacent sealing segments 100 unite to form circumferentially extending sealing fins.

The root 84 of each sealing segment 86 is integrally connected to the panel 88 by a column 85. Adjacent the free end of the the panel 88 an integral tie 87 is provided which extends from the panel 88 to the root 84. The shape and size of the tie 87 is chosen so as to resist centrifugal forces which would tend to move the free end of the panel 88 radially outwards under centrifugal force. Similarly the root 98 of each sealing segment 100 is integrally connected to the panel 102 by a column 99. Adjacent the free end of the the panel 102 an integral tie 101 is provided which extends from the panel 102 to the root 98. The shape and size of the tie 101 is chosen so as to resist centrifugal forces which would tend to move the free end of the panel 102 radially outwards under centrifugal force.

The free ends of the sealing segments 86 are each provided with a circumferentially extending groove 89, and the corresponding free ends of the sealing segments 100 are also provided with a circumferentially extending groove 103. A sealing strip 106 is positioned in the space formed by the two facing grooves 89 and 103. An H-shaped sealing strip may also be employed as shown in FIG. 13 at 302. In this form, the edges of the panels 88 and 100 will have reduced thicknesses at their ends 300 as shown in FIG. 13. Also, the axially extending edges of the segments can be united and sealed relative to adjacent segments by the same means on the ends of the formations.

Figure 4:
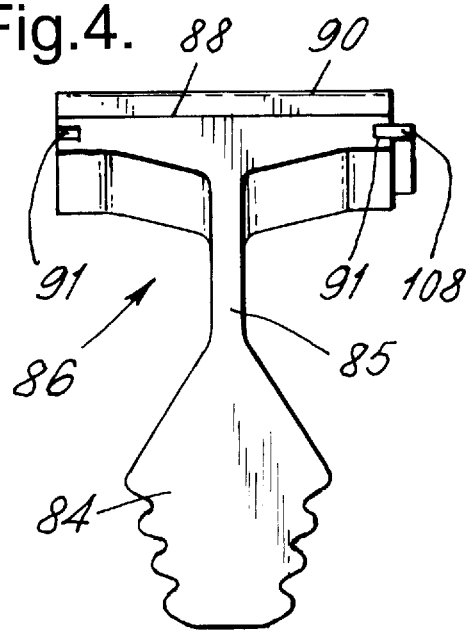
FIG. 4 shows an end view of one of the sealing segments shown in FIG. 3.
Figure 5:
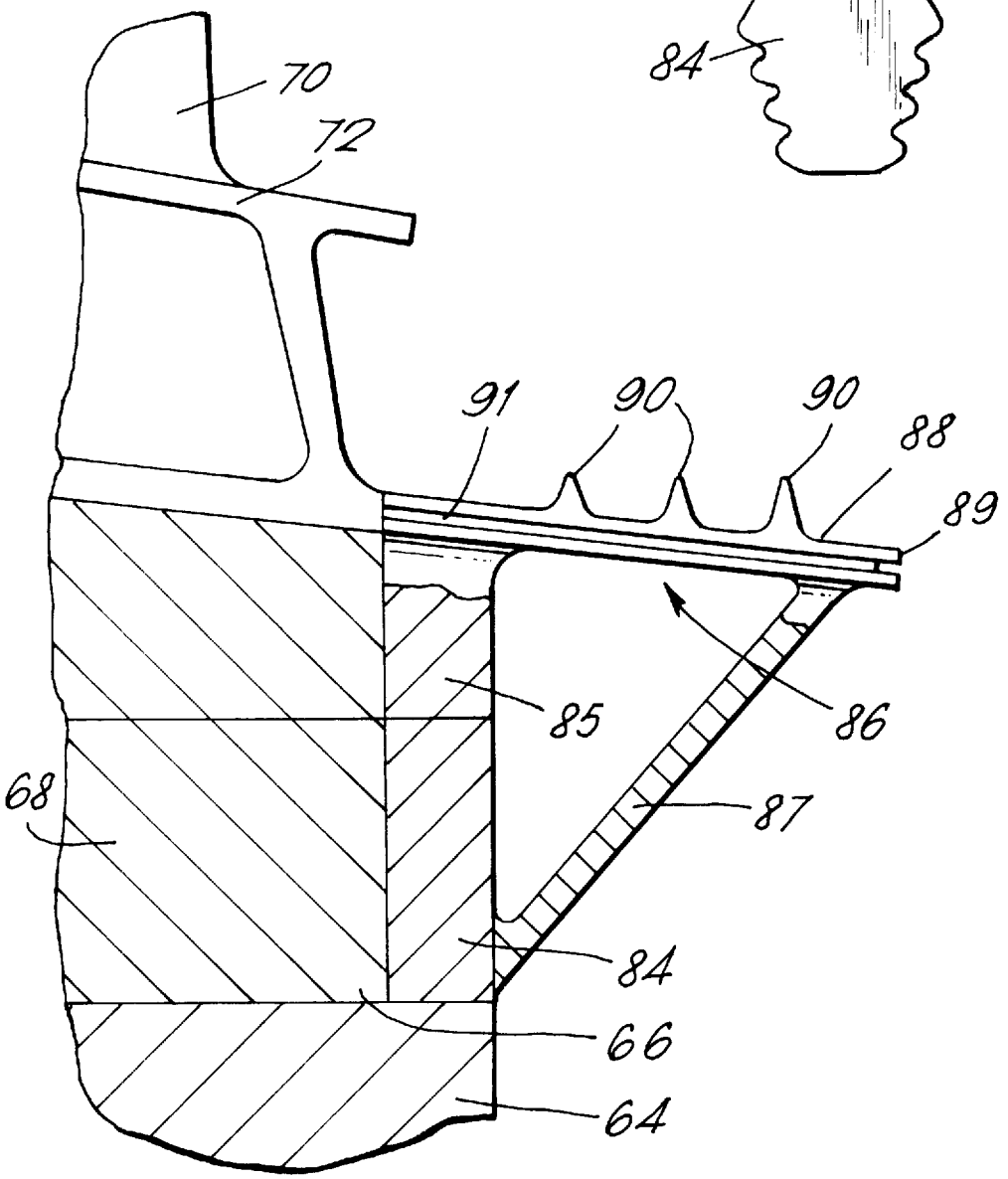
FIG. 5 shows a part of FIG. 3 to an enlarged scale.

In a similar manner the sides of the sealing segments 86 and 100 which abut adjacent sides of adjacent sealing segments 86, 100 and which extend generally in the axial direction are provided with comparable slots 91 and 105. Complementary sealing strips 108 are located in the spaces formed between each of the facing slots 91 and 105, as seen in FIG. 4.

It will be understood that the panels 88 and 102 of the sealing segments 86 and 100 respectively are subject to high centrifugal force and tend to move radially outwards under the influence of such force, even when restrained by the ties 87 and 101.

In order to guard against such centrifugal force withdrawing the roots 84 and 98 from the serrations 66 and 76 respectively, the roots 84 and 98 of the sealing segments 86 and 100 respectively and the adjacent roots 68 and 78 of the respective rotor blades 70 and 80 are provided with complementary positive interlocking formations which lock the roots 84 and 98 of the sealing segments 86 and 100 to the roots 68 and 78 of the rotor blades 70 and 80 and prevent the roots 84 and 98 from leaving the serrations 66 and 76 respectively.

The interlocking formations may take any convenient form, but a dovetail or a T-slot connection is desirable.

Figure 6:
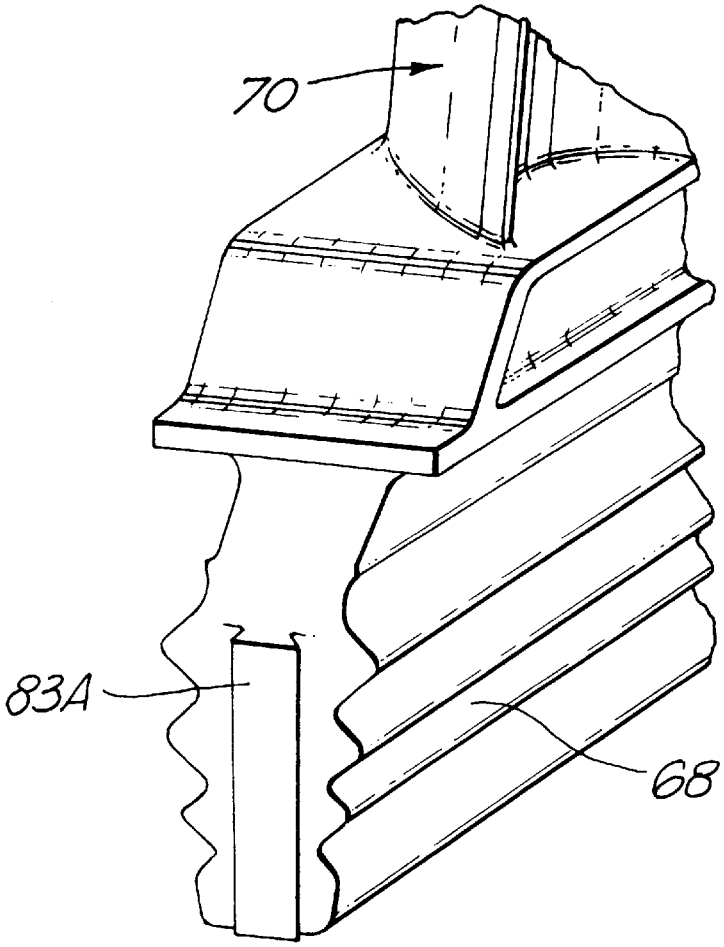
FIG. 6 is a perspective view of a rotor blade root shown in FIG. 3.
Figure 7:
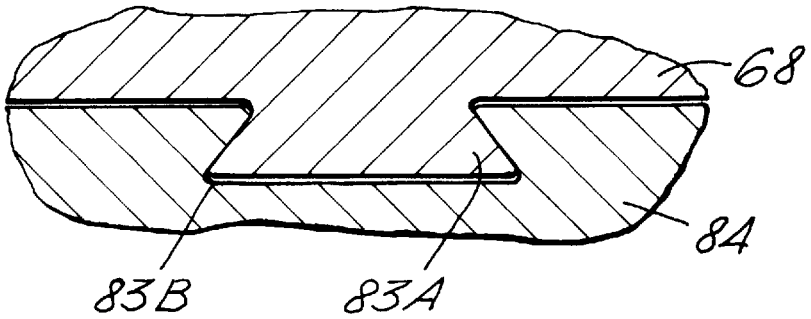
FIG. 7 is a cross-sectional view of the rotor blade root and sealing segment root interface.
Figure 8:
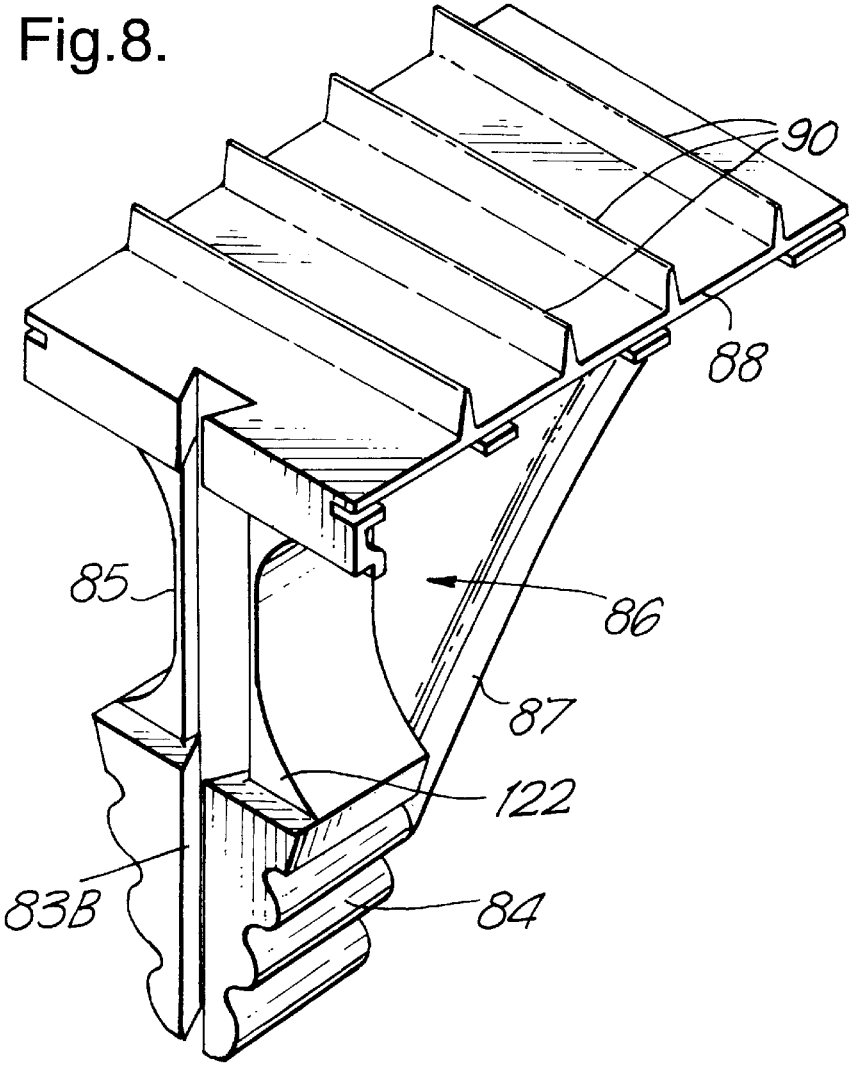
FIG. 8 is a perspective view of sealing segment.

FIGS. 6, 7 and 8 show how the root 68 of the rotor blade 70 may be provided within a dovetail tongue 83A which engages in a dovetail slot 83B in the root 84 of the sealing segment 86. It is of course possible to provide the tongue on the sealing segment and the slot on the blade.

Figure 9:
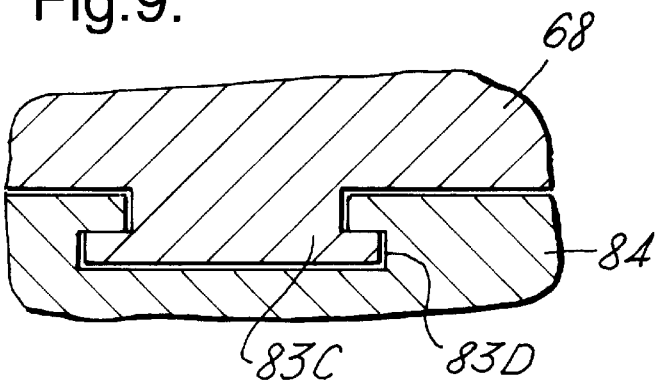
FIG. 9 is an alternative cross-sectional view of the rotor blade root and sealing segment root interface.

FIG. 9 illustrates a variation wherein the root 68 of the rotor blade 70 is provided with a T-shaped tongue 83C which engages within a T-shaped slot 83D in the root 84 of the sealing segment 86. Again the converse is possible. Rounded dovetails or T-slots are preferred as they present less stress concentrating sharp corners.

This positive interconnection between the roots 68 of the rotor blades 70 and the roots 84 of the sealing segments 86 restrains the roots 84 against movement out of the serrations 66 and makes for a very firm and permanent retention of the sealing segments in position.

Of course the sealing segments 100 are treated in precisely the same manner.

The interconnection between the sealing segments 86 and the respective rotor blades 70 may be realised in several different forms. In the forms illustrated in FIGS. 6, 7, 8 and 9 it will be appreciated that the roots 84 of the sealing segments 86 and the roots 68 of the rotor blades 70 are first united by sliding in a radial direction. The united components are then slid in a generally axial direction into the serrations 66. In an alternative, the dovetail slots and grooves may extend circumferentially rather than radially and the sealing segments 86 and the rotor blades 70 may be united by relative circumferential movement before being inserted into the serrations 66 in a generally axial direction.

Other variations are possible, for example one of the roots may be provided with a tennon and the other a mortice, a fastener or fasteners being passed through the two to unite the tennon and the mortice as shown in FIG. 14.

Instead of sealing strips being provided, adjacent panels could be provided with alternate tongue and grooved edges so as to cooperate with groups of similar sealing segments. In the same way the free edges may be provided with alternate tongue and grooves so as to cooperate without the need for separate sealing strips. Other possibilities are available.

The ties need not be integral but may be replaced by separate members specifically constructed to withstand tension.

Figure 10:
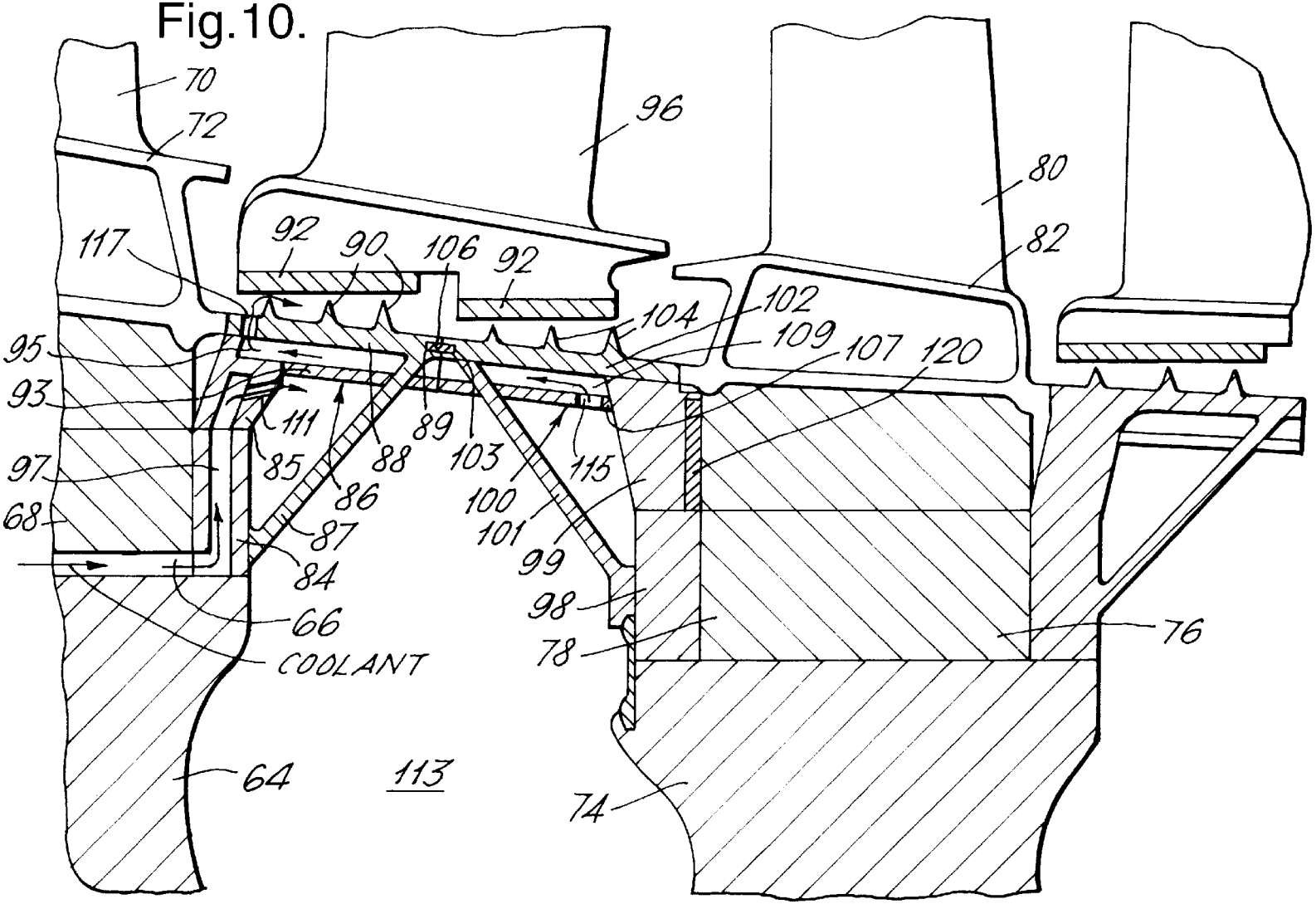
FIG. 10 shows part of a gas generator incorporating an alternative gas flow path sealing construction according to the present invention.
Figure 11:
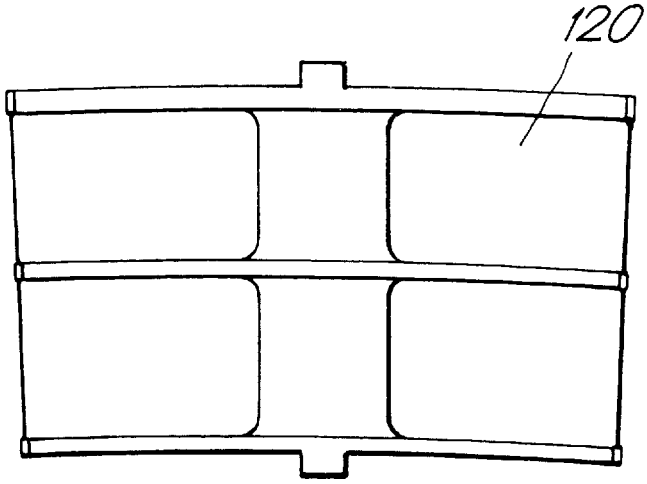
FIG. 11 is a view of a sealing plate for the sealing segment shown in FIG. 10.

A further variation is illustrated in FIGS. 10 and 11 in which the sealing segments 86, 100 are provided with axially extending spines 93, 107 at the circumferentially central region of the panels 88, 102. The spines 93, 107 of the sealing segments 86, 100 are hollow to define axially extending interconnecting passages 95, 109 for the flow of cooling fluid. The roots 84 and columns 85 of the sealing segments 86 on the first stage rotor disc 64 are hollow to define radially extending passages 97 for the flow of cooling fluid. The passages 97 in the roots 84 and columns 85 of the sealing segments 86 on the first stage rotor disc 64 are closed at their radially outer ends, the columns 85 have apertures 111 to discharge the cooling fluid from the passages 97 into the space 113 between the adjacent first and second stage rotor discs 64 and 74. The downstream ends of the spines 107 of the sealing segments 100 on the second stage rotor disc 74 have apertures 115 to allow cooling fluid to flow from the space 113 between the first and second stage rotor discs 64 and 74 into the axially extending passages 109 in the spines 107 of the sealing segments 100. The upstream ends of the panels 88 of the sealing segments 86 on the first stage rotor disc 64 have apertures 117 to discharge cooling fluid into the annular gas flow passage.

The cooling fluid is supplied into the serrations 66 of the first stage rotor disc 64 and the cooling fluid flows in an axially downstream direction along the serrations 66 to the roots 84 of the sealing segments 86. The cooling fluid then flows radially up the passages 97 and through the apertures 111 into the space 113. The cooling fluid flows in an axially downstream direction through the space 113 to the apertures 115 in the spines 107 of the sealing segments 100. The cooling fluid then flows in an axially upstream direction sequentially through the passages 107 and 95 in the spines 105 and 93 of the sealing segments 100 and 86 respectively. The cooling fluid is then discharged from the upstream end of the passages 95 into the annular gas flow passage through apertures 117 in the panels 88 of the sealing segments 86. The cooling fluid then flows axially downstream through the labyrinth seal formed between the sealing fins 90 and the surfaces 92 on the stator vanes. The cooling fluid may be air, steam etc.

As shown in FIG. 10 a plurality of sealing plates 120 are located axially between the sealing segments 100 and the rotor blades 80, and in this particular arrangement there are equal numbers of sealing segments 100 and sealing plates 120. Each of the sealing segments 100 is provided with a recessed region 122, as seen in more clearly in FIG. 8, on their faces having the interlocking formations for connection to the roots 78 of the rotor blades 80. Thus the recessed regions 122 are radially between the root portions 98 and the panels 102 of the sealing segments 100. Each of the sealing plates 120 locates in a recessed region 122 of a corresponding one of the sealing segments 100, and the edges of the sealing plates 120 cooperate to form a circumferentially extending seal. Thus the sealing plates 120 separate the cooling fluid for the rotor blades 80 from the cooling fluid in chamber 113.

The cooling fluids may be air, gas, steam etc. The cooling fluids at opposite sides of the sealing plates may be different fluids, i.e. steam and air, or the same or different fluids at different pressures.

It may be possible to arrange for other arrangements of cooling flow in the roots, spines and columns of the sealing segments.

Figure 12:
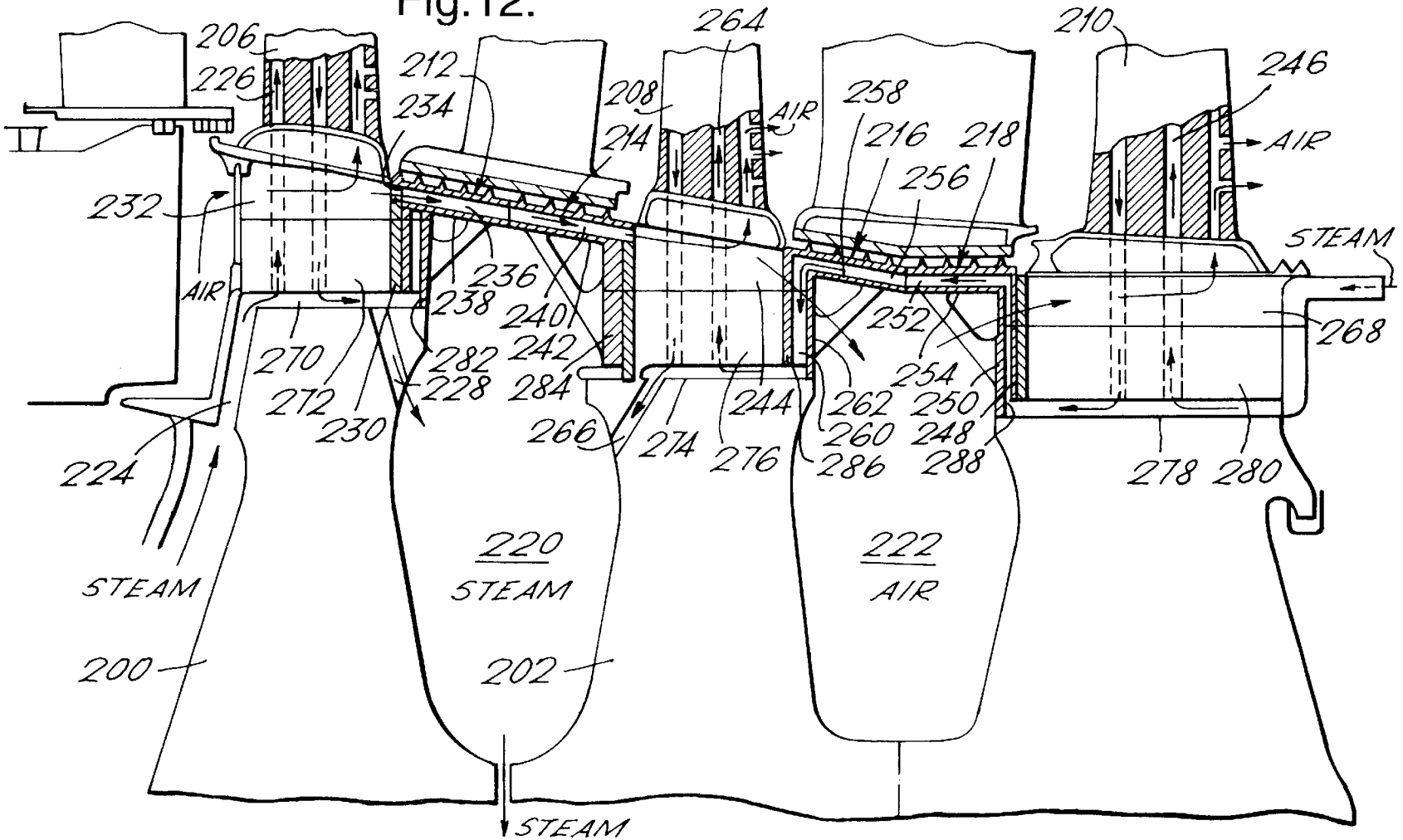
FIG. 12 shows part of a gas generator incorporating an alternative gas flow path sealing construction according to the present invention.

In FIG. 12 an alternative arrangement is shown in which the sealing segments are provided with axially extending spines at the circumferentially central region of the panels. The arrangement differs from that in FIG. 10 in that two different cooling fluids are used to cool the turbine rotor blades. Steam is supplied in a closed cycle loop to cooling passages at least at the leading edge, or central region, of the turbine rotor blades and air is supplied in an open cycle to cooling passages at least at the trailing edge of the turbine rotor blades. The cooling air is discharged from the cooling passages at the trailing edge of the turbine rotor blades into the working fluid.

The first stage rotor disc 200 carries turbine rotor blades 206, the second stage rotor disc 202 carries turbine rotor blades 208 and the third stage rotor disc 204 carries turbine rotor blades 210. A first set of sealing segments 212 extends in a downstream direction from the first rotor disc 200 and a second set of sealing segments 214 extends in an upstream direction from the second rotor disc 202. Similarly a third set of sealing segments 216 extends in a downstream direction form the second rotor disc 202 and a fourth set of sealing segments 218 extends in an upstream direction from the third rotor disc 204. A chamber 220 is formed between the first and second rotor discs 200 and 202, and a chamber 222 is formed between the second and third rotor discs 202 and 204.

Steam is supplied through passages 224 and along serrations in the first rotor disc 200 to the passages 226 at the leading edge of the turbine rotor blades 206. The steam is returned from the passages 226 in the turbine rotor blades 206 through passages 228 in the first rotor disc 200 to the chamber 220. A plurality of seal plates 230 are provided between the sealing segments 212 and the turbine rotor blades 206 to separate the chamber 220 from the spaces 232 between the shanks of the turbine rotor blades 206.

Air is supplied to the spaces 232 between the shanks of the turbine rotor blades 206 and a first portion of the air flows into cooling air passages at the trailing edges of the turbine rotor blades 206. A second portion of the air supplied to the spaces 232 flows through apertures 234 in the seal plates 230 to the axially extending passages 236 in the spines 238 of the sealing segments 212. The air supplied to the passages 236 flows into axially extending passages 240 in the spines 242 of the sealing segments 214. A plurality of seal plates are provided between the sealing segments 214 and the turbine rotor blades 208 to separate the chamber 220 from the spaces 244 between the shanks of the turbine rotor blades 208. The cooling air flowing through the passages 240 flows into the spaces 244 between the shanks of the turbine rotor blades 208 and a first portion of the cooling air flows into cooling air passages at the trailing edges of the turbine rotor blades 208. The remaining portion of the air supplied to the spaces 244 flows into the chamber 222. The cooling air flowing through the cooling air passages at the trailing edge of the turbine blades is discharged into the gas flow.

Steam is supplied along the serrations in the third rotor disc 204 to the passages 246 at the leading edge of the turbine rotor blades 210. The steam is returned from the passages 246 in the turbine rotor blades 210 and along the serrations in the third rotor disc 204 to the sealing segments 218. The sealing segments 218 have radially extending passages 248 in their bodies 250 and axially extending passages 252 in their spines 254. The passages 252 align with axially extending passages 256 in the spines 258 of the sealing segments 216. The sealing segments 216 also have radially extending passages 260 in their bodies 262. The passages 248, 252, 256 and 260 convey cooling steam to the serrations in the second rotor disc 202. The steam then flows to the passages 264 at the leading edge of the turbine rotor blades 208. The steam is returned from the passages 264 to the serrations and is discharged through passages 266 in the second rotor disc 202 to the chamber 220.

Air is supplied from chamber 222 into the spaces 268 between the shanks of the turbine rotor blades 210 and then the air flows into cooling air passages at the trailing edges of the turbine rotor blades 210. The cooling air flowing through the cooling air passages at the trailing edge of the turbine blades is discharged into the gas flow.

We claim:

1. A sealing arrangement between two axially spaced adjacent discs of a gas turbine, the rotor discs having serrations in their periphery, the rotor and discs having rotor blades, the rotor blades having roots locating in the serrations in the rotor discs, the rotor blades having blade platforms, the sealing arrangement including, on each said rotor disk, a circumferentially extending sealing formation extending from the rotor disc axially towards the other rotor disc and bridging part of the axial spaced the two rotor discs, the two sealing formations having free ends which cooperate to form a seal, each sealing formation comprising a plurality of segments, each segment having a root locating in the rotor disc serrations with said root of each segment extending substantially radially from each segment, the root of each segment being located in the same disc serrations as a root of a rotor blade, the root of the each segment being removably connected to the root of the respective one of the rotor blades to restrain said segment against axial movement out of the serration, the root of each blade having an axial upstream face and an axial downstream face, the root of each segment having an axial face, each connection comprising complementary positive interlocking formations on the axial face of the root of the segment and the corresponding axial face of the root of the rotor blade.

2. An arrangement as claimed in claim 1 wherein the sealing formations are each about half the blade platform to blade platform spacing in axial extent.

3. An arrangement as claimed in claim 1 wherein the complementary positive interlocking formations comprises a dovetail tongue and a dovetail slot.

4. An arrangement as claimed in claim 1 wherein the complementary positive interlocking formations comprises a T-shaped tongue and a T-shaped slot.

5. An arrangement as claimed in claim 1 wherein the complementary positive interlocking formations comprises a tennon and a mortice slot and a fastener passed through the tennon and mortice.

6. An arrangement as claimed in claim 3 wherein the complementary positive interlocking formations comprises said dovetail tongue on the root of the the blade and said dovetail slot on the root of the segment.

7. An arrangement as claimed in claim 4 wherein the complementary positive interlocking formations comprises said T-shaped tongue on the root of the blade and said T-shaped slot on the root of the segment.

8. An arrangement as claimed in claim 5 wherein the complementary positive interlocking formations comprise said tennon on the root of the blade and a mortice slot on the root of the segment and said fastener passed through the tennon and mortice.

9. An arrangement as claimed in claim 1 wherein the sealing formations are short frusto-conical spigots.

10. An arrangement as claimed in claim 1 wherein the free ends of the two sealing formations are inter-engaged in the manner of a tongue and groove connection to form a seal.

11. An arrangement as claimed in claim 1 wherein each free end of each sealing formation is formed with a slot and a sealing strip is inserted within the spaces defined between the slots.

12. An arrangement as claimed in any one of claims 3, 4, 5, 6, 7 or 8, wherein each sealing segment has first been connected to its adjacent blade root by sliding in one direction and the combined blade root and segment root have been slid into the disc serration.

13. A sealing arrangement as claimed in claim 1 wherein at least one sealing plate is located between at least one of the sealing formations and the corresponding rotor disc.

14. A sealing arrangement as claimed in claim 13 wherein there are a plurality of sealing plates, each sealing plate locates in a recess of a respective one of the sealing formations.

15. A sealing arrangement between two axially spaced adjacent discs of a gas turbine rotor, the rotor discs having serrations in their periphery, said rotor discs having rotor blades, said rotor blades having roots locating in the serrations in the rotor discs, said rotor blades having blade platforms, the sealing arrangement including, on each said rotor disc, a circumferentially extending sealing formation extending from the rotor disc axially towards the other rotor disc and bridging part of the axial space between the two rotor discs, the two sealing formations having free ends which cooperate to form a seal, and each sealing formation comprising a plurality of segments, the segments locating in the rotor disc serrations, each sealing segment comprising a body having a radially inner root portion provided with serrations complementary to the serrations provided in the periphery of the rotor disc, a column extending radially from such root portion, a relatively thin sealing panel which provides radially outwardly extending fins for sealing engagement with platforms on the inner ends of cooperating stator vanes, the column supporting the thin sealing panel, said panel having a generally axially extending spine united with its column, said spines of the sealing segments being hollow to define axially extending passages for the flow of cooling fluid, said axially extending passages in said spines on the sealing segments on the upstream rotor discs being in alignment with the axially extending passages in said spines on said sealing segments on the downstream rotor disc.

16. An arrangement as claimed in claim 15 wherein a tie extends from the body of the segment to a position adjacent the free end of the segment to carry the centrifugal force acting on the panel.

17. An arrangement as claimed in claim 16 wherein the tie is integral with the panel and the body.

18. An arrangement as claimed in claim 16 wherein the tie is separate and specifically designed to withstand tension.

19. An arrangement as claimed in claim 15 wherein the bodies of the sealing segments on at least one of the upstream rotor disc or the downstream rotor disc are hollow to define radially extending passages for the flow of cooling fluid.

20. An arrangement as claimed in claim 19 wherein the passages in the bodies of the sealing segments on the upstream rotor disc are closed at their radially outer ends, the bodies have apertures to discharge the cooling fluid into the space between the adjacent rotor discs, and the downstream ends of the spines of the sealing segments on the downstream rotor disc have apertures to allow cooling fluid to flow from the space between the adjacent rotor discs into the axially extending passages in the spines of the sealing segments.

21. A sealing arrangement as claimed in claim 20 wherein the sealing segments on the upstream rotor disc have apertures at their upstream ends to discharge the cooling fluid radially outwardly into the gas flowpath.

22. A sealing arrangement between two axially spaced adjacent discs of a gas turbine rotor, the rotor discs having serrations in their periphery, the rotor and discs having rotor blades, the rotor blades having roots locating in the serrations in the rotor discs, the rotor blades having blade platforms, the sealing arrangement including, on each said rotor disk, a circumferentially extending sealing formation extending from the rotor disc axially towards the other rotor disc and bridging part of the axial space between the two rotor discs, the two sealing formations having free ends which cooperate to form a seal, each sealing formation comprising a plurality of segments, each segment having a root locating in the rotor disc serrations, the root of each segment being located in the same disc serrations as a root of a rotor blade, the root of each segment being connected to the root of the respective one of the rotor blades to restrain said segment against axial movement out of the serration, each connection comprising complementary positive interlocking formations on the root of the segment and the root of the rotor blade, said sealing formations having free ends provided with respective tongues and the two facing tongues being engaged within and H-section sealing strip.

23. An arrangement as claimed in claims 10, 11 or 22 wherein the segments have generally axially extending edges, the generally axially extending edges of the individual segments are united and sealed relative to adjacent segments by the same means on the ends of the formations.

* * * * *